US010890173B2

(12) United States Patent
Fowler

(10) Patent No.: US 10,890,173 B2
(45) Date of Patent: Jan. 12, 2021

(54) OPERATION OF PUMP STATIONS WITH ADDITIVE PUMPS

(71) Applicant: Natural Gas Solutions North America, LLC, Houston, TX (US)

(72) Inventor: Robert Erling Fowler, Houston, TX (US)

(73) Assignee: Natural Gas Solutions North America, LLC, Houston, TX (US)

( * ) Notice: Subject to any disclaimer, the term of this patent is extended or adjusted under 35 U.S.C. 154(b) by 243 days.

(21) Appl. No.: 15/894,552

(22) Filed: Feb. 12, 2018

(65) Prior Publication Data

US 2019/0249658 A1 Aug. 15, 2019

(51) Int. Cl.

| | |
|---|---|
| ***F04B 49/025*** | (2006.01) |
| ***F04B 23/02*** | (2006.01) |
| ***F04B 49/22*** | (2006.01) |
| ***F04B 13/00*** | (2006.01) |
| ***F04B 51/00*** | (2006.01) |

(52) U.S. Cl.

CPC ..... *F04B 49/025* (2013.01); *F04B 13/00* (2013.01); *F04B 23/02* (2013.01); *F04B 49/22* (2013.01); *F04B 51/00* (2013.01); *F04B 2205/09* (2013.01)

(58) Field of Classification Search

CPC ..... F04B 1/0443; F04B 13/00; F04B 23/02; F04B 49/025; F04B 49/22; F04B 51/00; F04B 2201/0208; F04B 2201/0405; F04B 2201/0803; F04B 2205/09

USPC ..... 417/36

See application file for complete search history.

(56) References Cited

U.S. PATENT DOCUMENTS

| | | | | |
|---|---|---|---|---|
| 3,139,156 | A * | 6/1964 | Urso | F16N 13/10 184/27.3 |
| 5,070,849 | A * | 12/1991 | Rich | F02M 37/106 123/509 |
| 5,906,374 | A | 5/1999 | Arbuckle | |
| 6,609,534 | B1 | 8/2003 | Beaney et al. | |
| 2007/0283806 | A1* | 12/2007 | Morrison | F04B 53/164 92/165 R |
| 2008/0289330 | A1* | 11/2008 | Gaffe | B60T 11/232 60/588 |
| 2015/0013646 | A1* | 1/2015 | Qi | G01F 23/263 123/478 |
| 2015/0361969 | A1 | 11/2015 | Rajewski | |
| 2017/0037848 | A1* | 2/2017 | Robison | F04B 53/143 |
| 2018/0156205 | A1* | 6/2018 | Yudanov | F04B 1/0443 |

FOREIGN PATENT DOCUMENTS

| | | | |
|---|---|---|---|
| CN | 103352867 | A | 10/2013 |
| WO | 03046516 | A1 | 6/2003 |
| WO | 2009067143 | A1 | 5/2009 |

* cited by examiner

*Primary Examiner* — Connor J Tremarche

(74) *Attorney, Agent, or Firm* — Paul Frank + Collins P.C.

(57) ABSTRACT

An additive pump is configured to collect migrant additive that penetrates into its reciprocating shaft. These configurations may include a pump head, an actuator that penetrates into the pump head, a sealed region disposed about the actuator to form a fluid-free zone, and a fluid sensing unit coupled with the sealed region, the fluid sensing unit comprising a receptacle that is configured to retain fluid that transits from inside the sealed region.

20 Claims, 9 Drawing Sheets

OPERATION OF PUMP STATIONS WITH ADDITIVE PUMPS

BACKGROUND

Additive pumps enjoy wide use in heavy industries. For example, these devices are known to incorporate into large injection stations (or "pump" stations) that are part of oil & gas extraction and distribution networks. The pump stations may inject chemicals (or "additives") into pipes and pipelines that carry hydrocarbons, typically to avoid corrosion or to lubricate components.

Pump stations often reside in remote locations. Terrain and distance to these locations may limit access to power, clean water, and other normal services. As a result, operators rarely staff the pump stations with personnel to operate (or regularly interact with) the equipment. Periodic inspection or maintenance may occur from time-to-time. But for the most part the sites operate essentially autonomously. For example, the additive pump may have a motor that operates on a timer or at calibrated speed to ensure proper amounts of additives disperse into the pipeline over time.

SUMMARY

The subject matter disclosed herein relates to improvements in additive pumps to address problems that may occur while operators are offsite from the pump station. Of particular interest are embodiments that can detect additive (or other materials) that migrates within the structure of the machine. These embodiments may respond to "migrant" additive, for example, by turning off the motor or providing some other alert to draw attention to the problematic operation. This response may prevent further damage to the additive pump, as well as to ensure timely maintenance to restart additive flow as quickly as possible to avoid damage to equipment or other problems that can manifest on the pipeline.

DRAWINGS

Reference is now made briefly to the accompanying drawings, in which.

Figure 1:
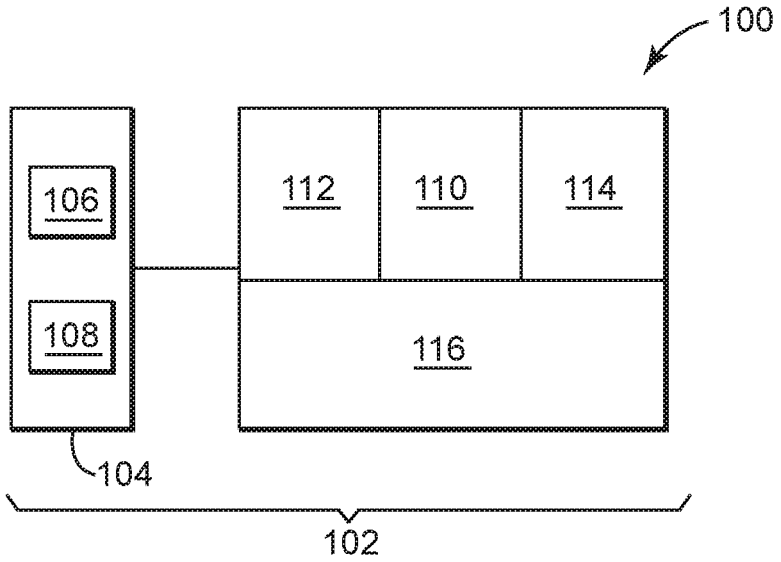
FIG. 1 depicts a schematic diagram of an exemplary embodiment of an additive pump.

Where applicable, like reference characters designate identical or corresponding components and units throughout the several views, which are not to scale unless otherwise indicated. The embodiments disclosed herein may include elements that appear in one or more of the several views or in combinations of the several views. Moreover, methods are exemplary only and may be modified by, for example, reordering, adding, removing, and/or altering the individual stages.

DETAILED DESCRIPTION

The discussion below describes various embodiments of an additive pump. These embodiments can facilitate maintenance and repair at pump stations found in remote locations. Practice-to-date nominally only discovers problems with additive pumps after operator inspection of the machine. But these practices rely almost exclusively on the operator's ability to observe abnormalities, like changes in pump performance or pooling of additive at the pump station. These observations often depend on experience and care of the operator. The practice also requires the operator to visit the pump stations, which for remote locations is not likely to occur on a timely basis and, thus, could allow the pipeline to carry material without any additive for extended periods of time. The embodiments below offer an alternative that can alert the operator to problems on the additive pumps. This alert can prevent prolonged operation of the additive pump in its failed state, which is particularly useful to ensure that the pump station continues to dose its required amount of additive into the pipeline (or conduit).

FIG. 1 depicts, schematically, an exemplary embodiment of an additive pump 100. This embodiment is found at a pump station 102, often as part of a fluid circuit 104 that includes a fluid source 106 and a pipeline 108. The fluid source 106 holds material, for example, a chemical additive like corrosion inhibitors or lubricants. Formulations for these additives are known to protect the pipeline 108 against corrosion and other problems that may manifest from flow of hydrocarbons (e.g., oil, natural gas, etc.). As also shown, the additive pump 100 may include a pump actuator 110 that couples with a pump head 112. A motive unit 114, like a motor or pneumatic cylinder, may operate the pump actuator 110 to cause additive to transit through the fluid circuit 104 from the source 106 into the pipeline 108 via the pump head 112. The additive pump 100 may also incorporate a fluid sensing unit 116.

Broadly, the additive pump 100 is configured to detect potential issues adverse to normal operation of the machine. These configurations may respond to movement or "migration" of fluid internal to the additive pump 100. This migration may result from part failure that allows additive to finds its way out of the pump head 108 and, for example, enter the pump actuator 110. The additive pump 100 may permit more timely diagnosis than "external" observations because the indication corresponds directly to the inner workings of the machine. This feature is beneficial because it may avoid, or at least reduce, damage that might require significant repair or wholesale replacement of the pump 100 altogether. The embodiments here can also avoid situations where additive simply does not reach the pipeline to avoid problems that might develop in the pipeline 108 and downstream of the pump station 102. As an added benefit, the additive pump 100 can collect the "migrant" fluid and, for chemical additive, re-circulate the fluid back to either the source 106 or the pump head 112 for discharge into the pipeline 108. This feature may prevent contamination of areas around the pump station 102 with additive 108 that leaks out from the additive pump 100 into areas around the pump station 102 that may prove hazardous (and against operating regulations).

The fluid sensing unit 116 is configured to facilitate both the diagnosis of problems and any timely response. These configurations may include devices that can collect additive that migrates into the pump actuator 110 from the pump head 112. These devices may, in turn, operate to cause appropriate actions to occur in response to the additive. These actions may turn off, or de-energize, the motive unit 114 to pre-empt any further damage to the additive pump 100. Other actions may cause operators to schedule maintenance ahead of some pre-determined scheduled maintenance activity.

Figure 2:
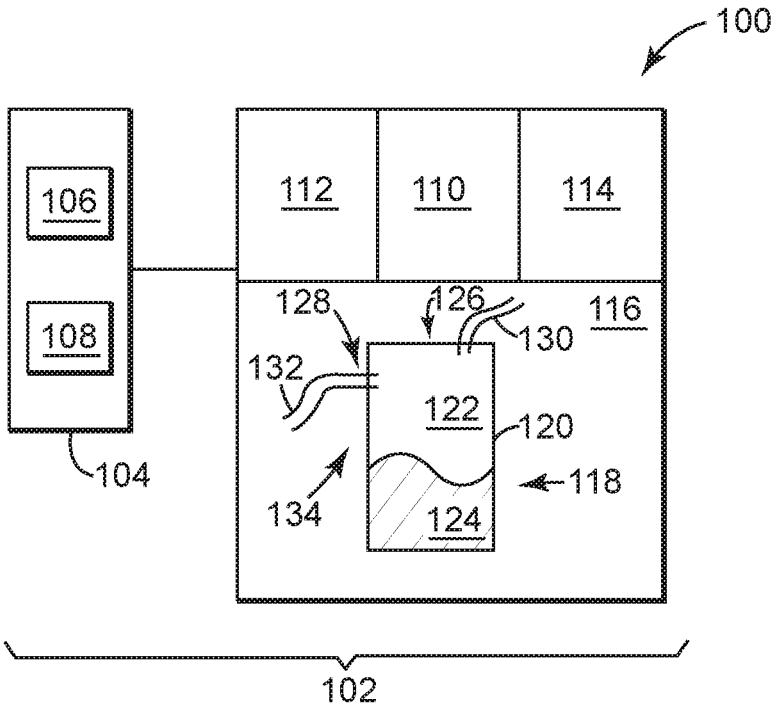
FIG. 2 depicts a schematic diagram of the additive pump of FIG. 1 with exemplary structure of a fluid sensing unit.

FIG. 2 depicts a schematic diagram of the additive pump 100 of FIG. 1 with details of exemplary structure for the fluid sensing unit 116. The structure may include a receptacle 118 that has a peripheral wall 120 forming an enclosure with a volume 122. Preferably the enclosure is "fluid-tight" to ensure that the receptacle 118 can retain fluid 124 therein. Examples of the enclosure may be cylindrical as shown; however, form factors for the structure likely depend on space available to allow the device to install on the additive pump 100. The peripheral wall 120 may incorporate one or more ports (e.g., a first port 126 and a second port 128). The ports 126, 128 may embody openings or apertures that penetrate the enclosure to permit access to the volume 122. Fluid fittings may affix at the ports 126, 128, if desired. These fittings may affix the receptacle 118 to one or more fluid lines (e.g., a first line 130 and a second line 132). The fluid lines 130, 132 may embody tubing or piping that couple on one end to the fittings at the ports 126, 128. The other end of the first line 130 may locate to receive "migrant" additive from one or more parts of the additive pump 100. The second line 132 may extend from the receptacle 118 to allow fluid 124 to re-enter the operative fluid circuit 104 of the pump station 102.

Figure 3:
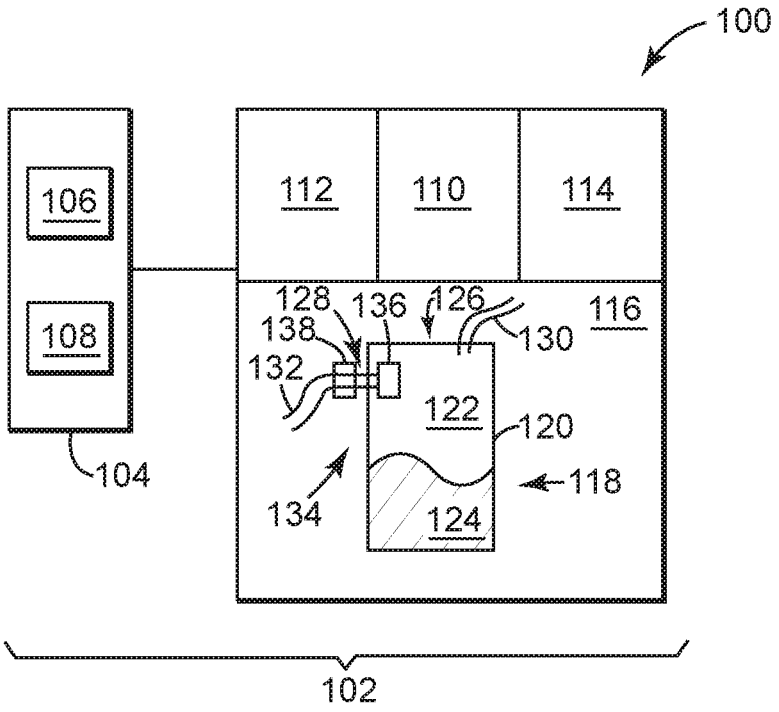
FIG. 3 depicts an example of the additive pump of FIG. 2.

FIG. 3 depicts an example of the additive pump 100 of FIG. 2. This example includes a flow control 134 that regulates flow through the port 128. The flow control 134 may include devices, identified herein as "valves" (e.g., a first valve 136 and a second valve 138), that function to selectively permit or restrict flow of fluid in one or more directions. The valves 136, 138 may reside inside and outside of the receptacle 118, respectively. On the inside, the first valve 136 may operate to form a seal at the port 128. This seal may correspond with fluid 124 at a level that is at or below the port 128. This feature can maintain suction at the pump head 112 when little or no fluid 124 is found in the receptacle 116. Devices for the first valve 136 may embody a floating unit, with a "float" that resides in a "cage." Construction may attach the cage to the peripheral wall 120 to restrain the float (e.g., a ball or sphere) in proximity to the port 128. The float breaks the seal in response fluid 124 at a level that is above the port 128 to allow fluid to exit the volume 122. Outside of the receptacle 118, the second valve 138 may embody a check valve or like device that permits "single-direction" flow. The check valve may prevent flow through the port 128 into the volume 124. This feature may prohibit backflow of additive from the source 106, particularly when the second line 132 connects to the fluid circuit 104, for example, to allow fluid 124 to flow from the volume 122 directly (or indirectly) into the source 106.

Figure 4:
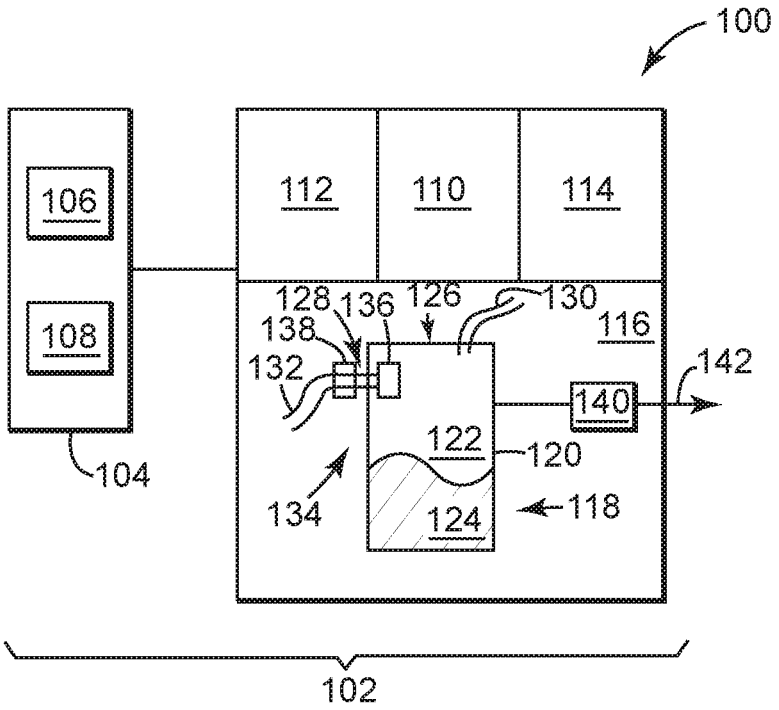
FIG. 4 depicts another example of the additive pump of FIG. 2.

FIG. 4 also depicts an example of the additive pump 100 of FIG. 2. Here, the example includes a sensor 140 that couples with the receptacle 118. The sensor 140 may be configured to generate a response to presence (or absence) of fluid 122 in the volume 120. This response may be a signal 142, which may assume a format that is digital or analog. This disclosure does also contemplates that the response could correspond with visualization of the level (or amount) of fluid 122 in the volume 120. For some implementations, the sensor 140 may include devices sensitive to parameters, like weight or moisture. Other devices may change position in accord with a level of fluid 124 in the volume 122. The change in position may trigger the signal 142. For some implementations, a beam-break device or similar optical device, possibly with a transmitter (to generate a light beam) and a receiver (to receive the light beam) disposed on opposite sides of the enclosure. These components may reside in position for the level of fluid 124 to break the light beam to trigger the signal 142. Still other devices may trigger the signal 142 in response to flow of fluid 124 out of the port 128.

Figure 5:
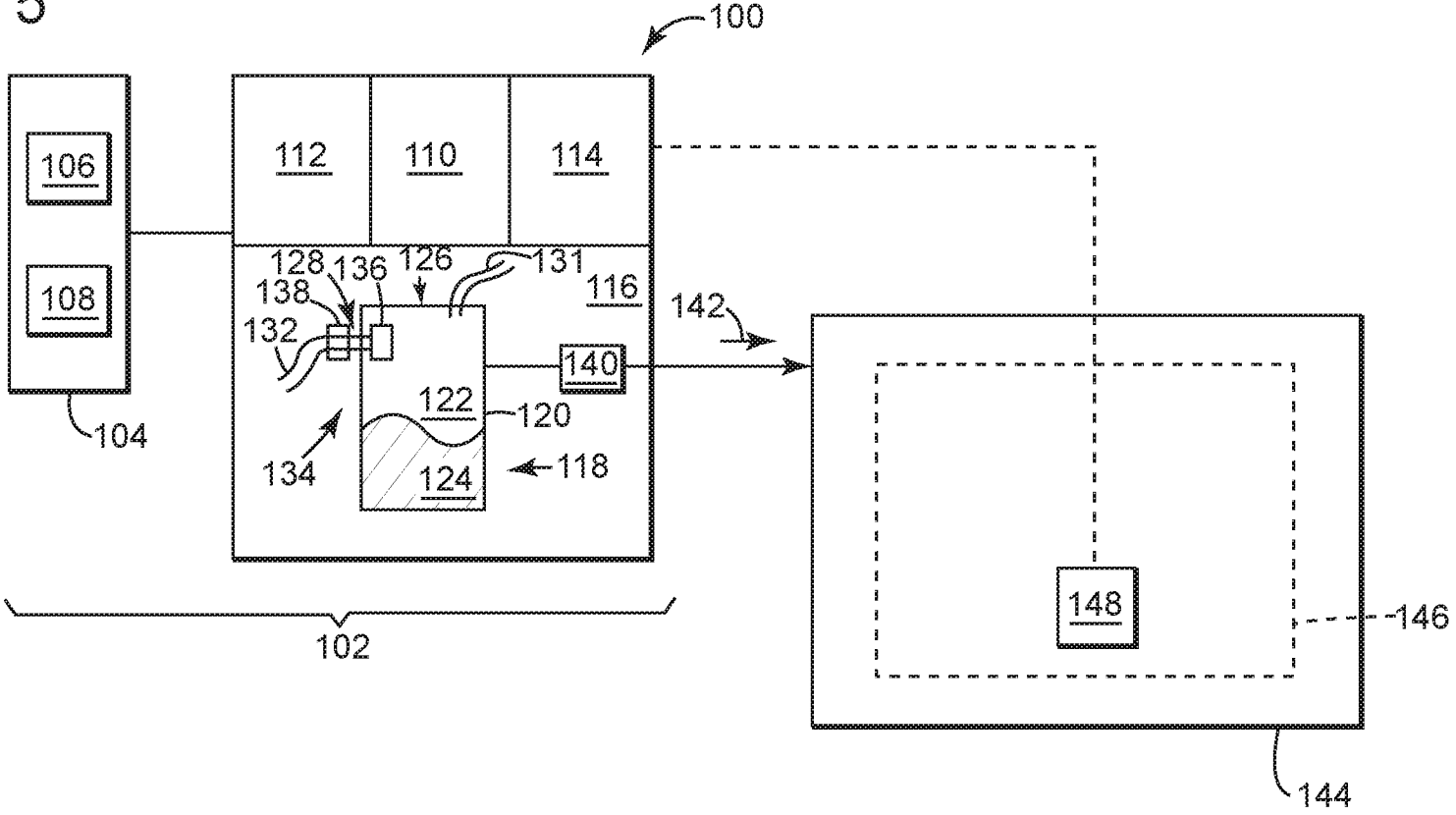
FIG. 5 depicts yet another example of the additive pump of FIG. 2.

FIG. 5 depicts another example of the additive pump 100 of FIG. 2. This example includes a controller 144 that couples with the sensor 140. At a high level, the controller 144 may include operative circuitry 146 that couples with the motive unit 114 or other parts of the additive pump 100. The operative circuitry 146 may include one or more discrete components, like a switch 148. Examples of the switch 148 may change states in response to signal 142. The states may correspond with different operative conditions for the motive unit 114. In one state, the motive unit 114 may operate the pump actuator 110 to cause additive to dispense from the pump head 112 into the pipeline 108. Another state may cause the motive unit 114 to stop or turn "off" to prevent most, if not all, discharge of additive from the pump head 112 into the pipeline 108. This state may, in turn, correspond with fluid 124 found in the receptacle 118, for example, in an amount that indicates some type of operating defect on the additive pump 100. Concurrently, it may benefit the design for an alert or alarm to activate, for example, in response to the state of the switch 148. Such alert (or alarm) may provide visual indication (a light) or sensory indication (an audible sound) to draw attention to the additive pump 100 at the pump station 102, often in order to bring the pump station 102 back on-line, whether by repair or replacement of the additive pump 100.

Figure 6:
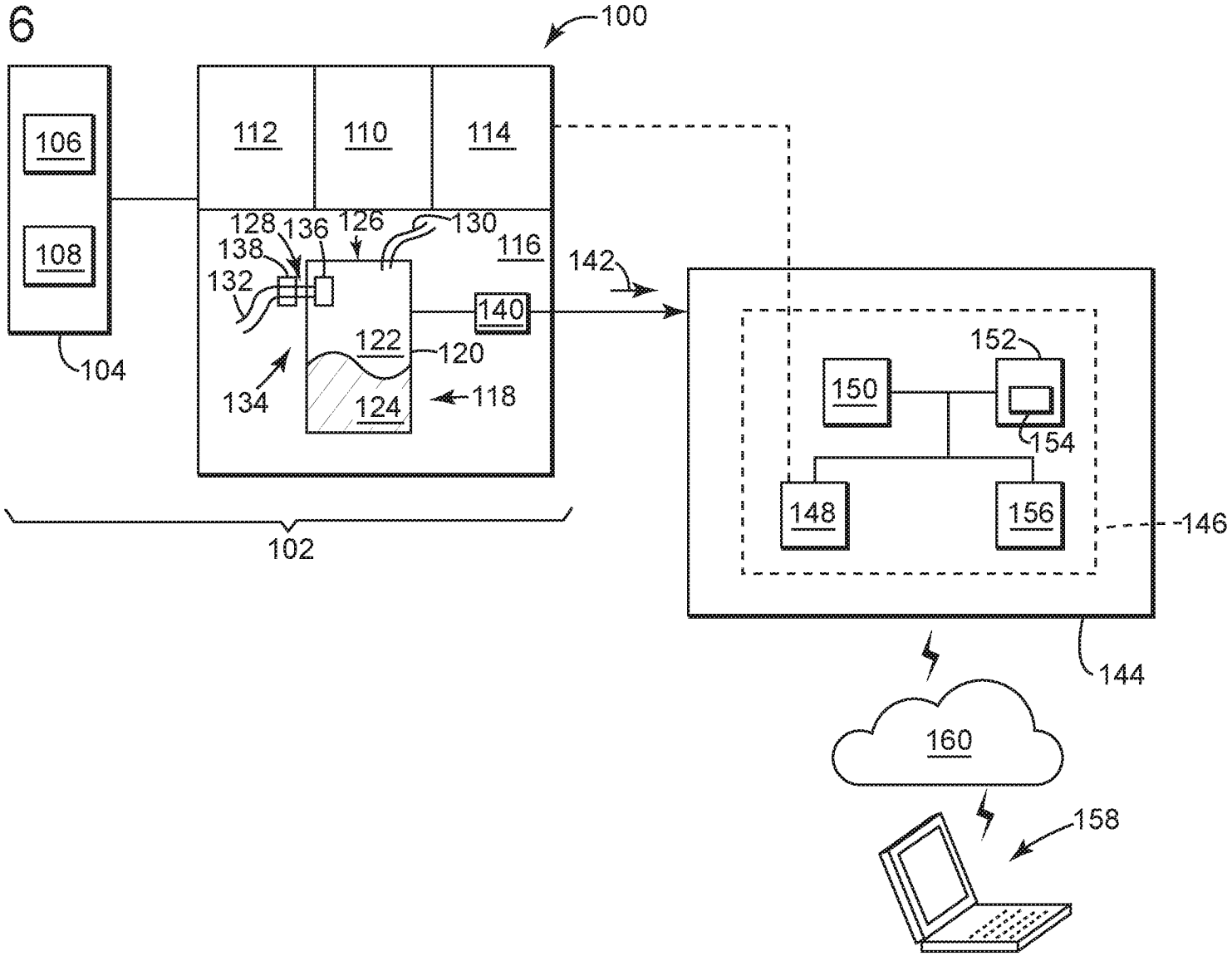
FIG. 6 depicts still another example of the additive pump of FIG. 2.

FIG. 6 depicts the additive pump 100 of FIG. 5 with additional details for the controller 144. The operative circuitry 146 may comprise computing components, like a processor 150 that couples with memory 152 having executable instructions 154 disposed thereon. The computing components 150, 152 may integrate into a microcontroller to provide on-board a single device certain functions to process the signal 142 or retain data. As also shown, it may benefit the design to incorporate a communication unit 156 that can exchange signals with a terminal 158, like a smartphone, a tablet, or similar computing device. Often this exchange may require a network 160, which may support wired and wireless protocols. The communication unit 156 may include structure, like a radio or an antenna, to leverage wireless protocols for this purpose. However, it may benefit the design for the operative circuitry 146 to interface with wires or cables that connect the terminal 158 to the controller 144, as well.

Figure 7:
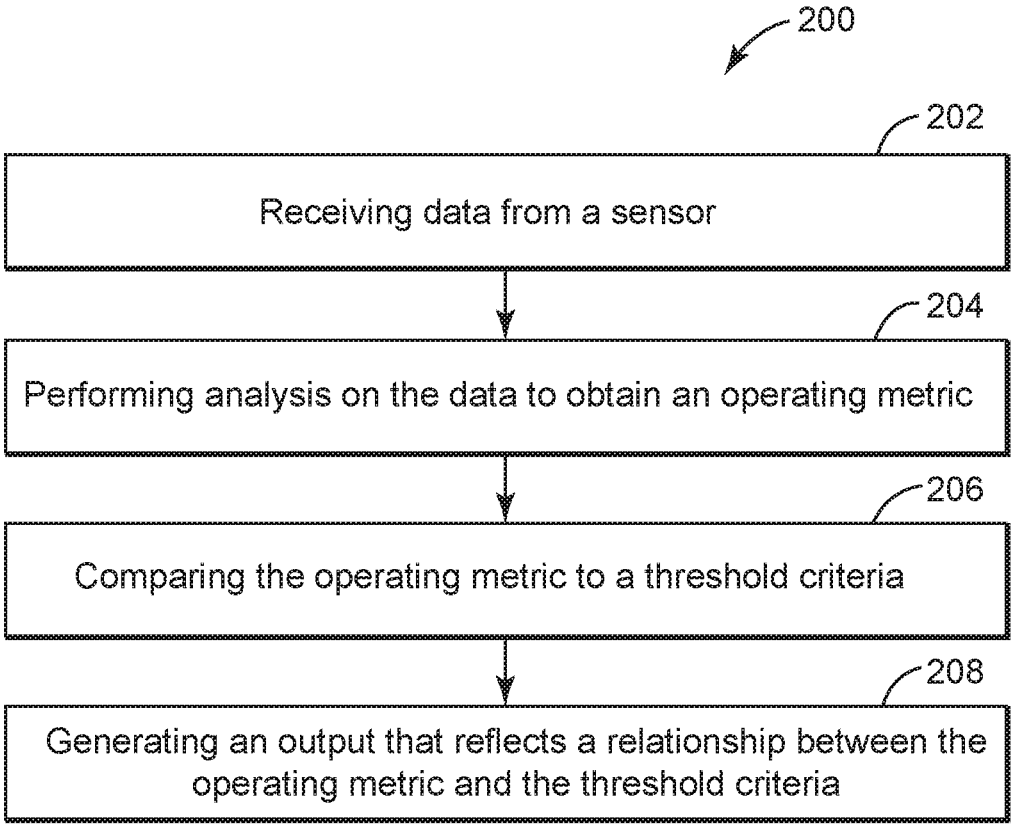
FIG. 7 depicts a flow diagram of an exemplary embodiment of a method.

FIG. 7 depicts a flow diagram of an exemplary method 200 to process the signal 140 from the sensor 138. This diagram outlines stages that may embody executable instructions 152 for one or more computer-implemented methods and/or programs. Where applicable, the executable instructions 152 may be stored on the controller 142 as firmware or software, but may also be found remote from the controller 142 as in the "cloud." The stages in this embodiment can be altered, combined, omitted, and/or rearranged in some embodiments.

Operation of the method 200 may enable diagnostics of the additive pump 100. The method 200 may include, at stage 202, receiving data from a sensor and, at stage 204, performing analysis on the data to obtain an operating metric. The method 200 may also include, at stage 206, comparing the operating metric to a threshold criteria. The method 200 may further include, at stage 208, generating an output that reflects a relationship between the operating metric and the threshold criteria.

At stage 202, the controller 144 may receive the data from the sensor 140. This stage may include stages for sampling data via the signal 142, for example, at some fixed time period or interval. Sampling may also occur in response to triggers or alerts from system controls that measure output metrics at the pump station 102 (or facility in general). The system may also "stream" data continuously. This feature may require additional stages to store (or write) data to a storage memory (or repository).

At stage 204, the controller 144 may perform analysis on the data. For analog data, the analysis may include stages to identify a value, like high voltage or low voltage. This value may indicate, for example, that fluid 124 in the volume 122 is at its high or "critical" level. Digital data, on the other hand, may require stages for using the data to calculate a value that quantifies some parameter, like weight, volume, or flow.

At stage 206, the controller 144 may compare the values or quantities with the threshold criteria. Examples of the threshold criteria may identify maximum height or volume of fluid 124 in the volume 122. These examples may be pre-set or part of a machine learning or diagnostic program that uses previous quantifies to set or reset the threshold criteria.

At stage 208, the controller 144 may generate the output. This stage may include stages for generating an alert that indicates potential performance issues for the additive pump 100. These issues may align with failure in bearings or seals that prevent egress of additive 108 into certain areas of the pump 100. The alert may prompt the operator to inspect the machine and, if necessary remove the device from service at the pump station 102. As noted above, the alert may also coincide with actions to change operation of the additive pump 100, for example, operating the switch 148 to shut off the motive unit 114.

Figure 8:
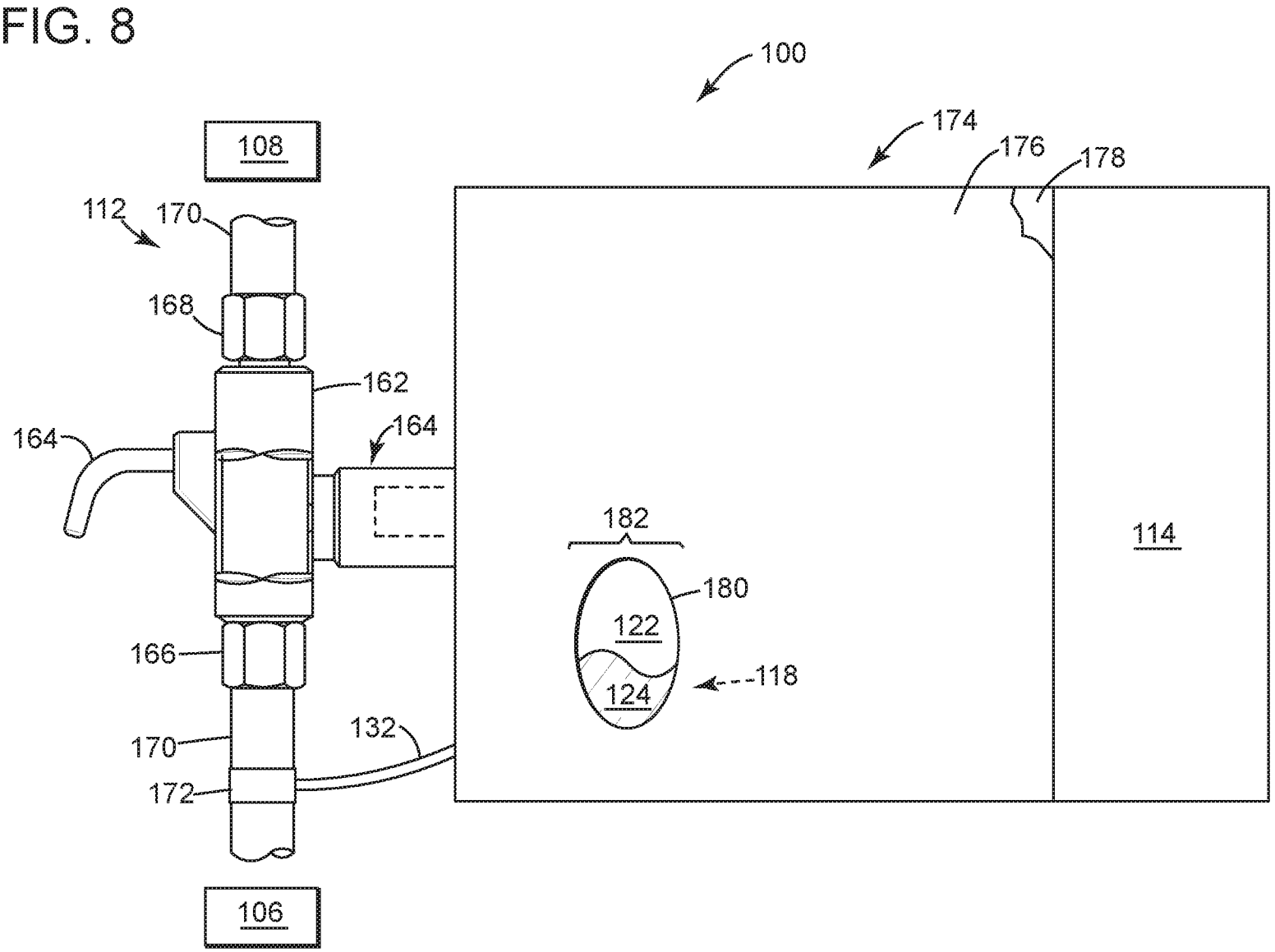
FIG. 8 depicts an elevation view, in partial schematic, of exemplary structure for the additive pump of FIG. 2.

FIG. 8 depicts an elevation view of an example of the additive pump 100. The pump head 112 may have a pump body 162 with a valve stem 164 and a pair of connectors (e.g., a first connector 166 and a second connector 168) disposed thereon. The connectors 166, 168 may receive conduit 170 that extends from the source 106 and the pipeline 108 as part of the fluid circuit 104. An interface connector 172 may couple with the second line 132 to allow fluid 124 to flow into the fluid circuit 104. Preference may be given to a threaded connector or a valve that interposes downstream of the first connector 166 (and the pump head 112). It is also possible that the interface connector 172 couples directly to, or integrates with, the pump body 162 or the first connector 166. As also shown, the additive pump 100 may provide structure to enclose parts of the pump actuator 112. This structure may include a housing 174 with a peripheral wall 176 that encloses an interior space 178. An aperture 180 can provide access through the peripheral wall 176. The housing 174 may incorporate a view window 182 at the aperture 180, possibly made of clear, transparent material (like plexi-glass) to afford visual access to components inside of the interior space 178. In one implementation, the receptacle 118 may mount in the interior space 178 close to the viewing window 182 to be visible from outside of the housing 174. This feature can allow an operator clear view of any fluid 124 that resides in the volume 122, which may correlate to potential issues on the additive pump 100.

Figure 9:
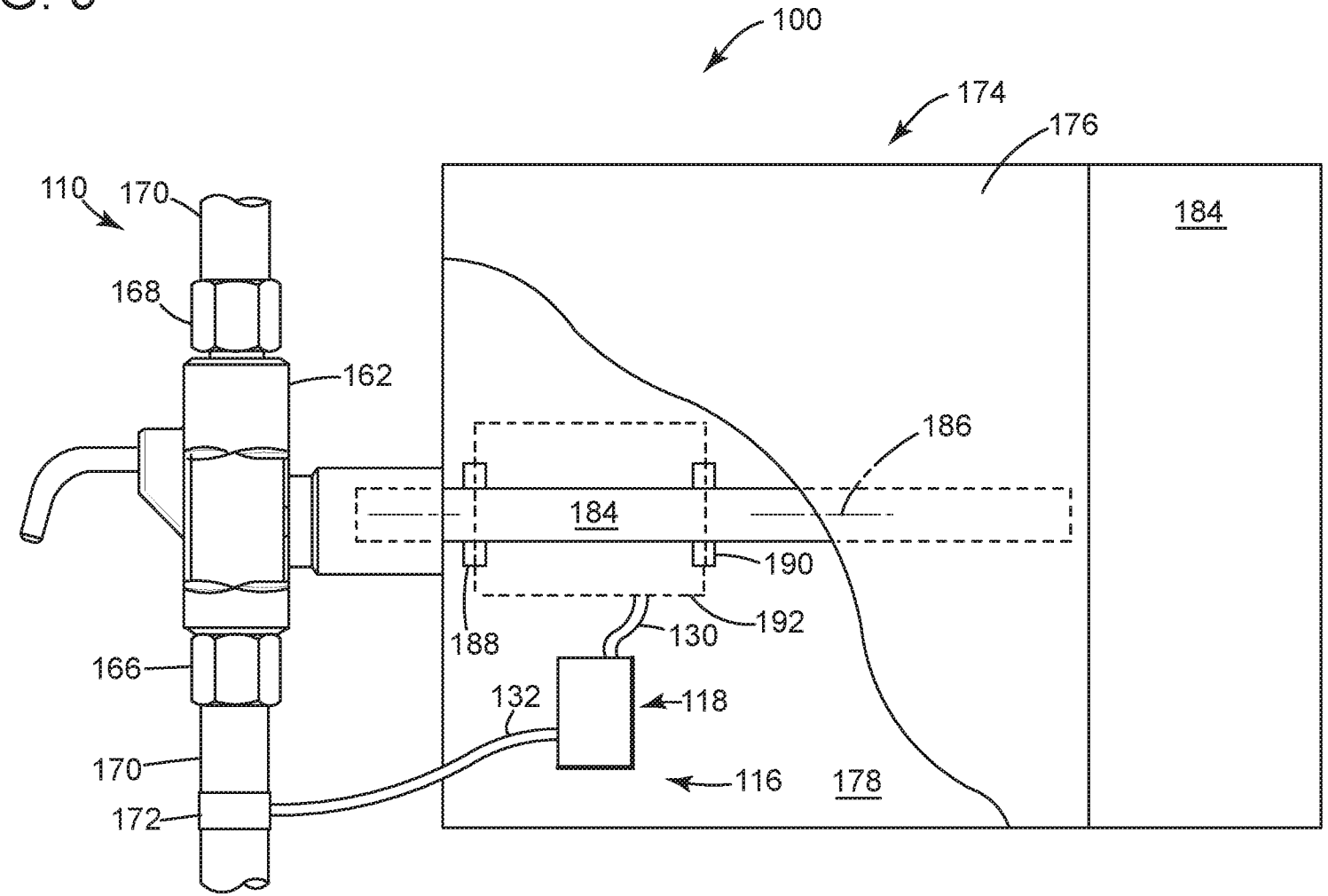
FIG. 9 depicts the additive pump of FIG. 8 with a partial cut-away.

FIG. 9 shows the additive pump 100 of FIG. 8 with a partial cut-away in the peripheral wall 176. In the interior space 178, the pump actuator 112 may include a shaft 184 with a longitudinal axis 186. The shaft 184 may extend into the pump head 110 at one end and couple with the motive unit 114 on the other. A pair of radial seals (e.g., a first radial seal 188 and a second radial seal 190) may engage with the shaft 184 to create a sealed region 192. The seals 188, 190 may provide moveable contact to allow the shaft 184 to reciprocate along the longitudinal axis 186; of course this disclosure also contemplates designs where the seals 188, 190 allow the shaft 184 to rotate about the longitudinal axis 186 as well. In this regard, the motive unit 114 can translate the shaft 184 relative to the pump body 162 to draw additive into its inlet side (at the first connector 166) and discharge it from its discharge side (at the second connector 168). Failure of the first radial seal 188 may allow additive to migrate into the sealed region 192 due, at least in part, to movement of the shaft 184. The fluid sensing unit 116 may couple with the sealed region 192 to allow migrant additive to flow into the receptacle 118, which in turn operates to detect and alert operators as discussed herein.

In light of the foregoing discussion, the improvements herein can ensure that additive flows from the pump station into pipelines consistently and with limited disruptions. The improvements can inform operators of operating conditions more at the pump station more timely and with better accuracy than any visual observations, which are subject to availability of operators on sight and near the pump station concurrently with problematic operation of the additive pump. Further, the improvements are meant to re-circulate additive that might escape from the additive pump. This feature outfits the device to align with environmental regulations or standards because it prevents leaks or spills that can contaminant areas around the pump station.

This written description uses examples to disclose the invention, including the best mode, and also to enable any person skilled in the art to practice the invention, including making and using any devices or systems and performing any incorporated methods. An element or function recited in the singular and proceeded with the word "a" or "an" should be understood as not excluding plural said elements or functions, unless such exclusion is explicitly recited. References to "one embodiment" of the claimed invention should not be interpreted as excluding the existence of additional embodiments that also incorporate the recited features. Furthermore, the claims are but some examples that define the patentable scope of the invention. This scope may include and contemplate other examples that occur to those skilled in the art. Such other examples are intended to be within the scope of the claims if they have structural elements that do not differ from the literal language of the claims, or if they include equivalent structural elements with insubstantial differences from the literal language of the claims.

Examples appear below that include certain elements or clauses one or more of which may be combined with other elements and clauses describe embodiments contemplated within the scope and spirit of this disclosure.

What is claimed is:

1. An apparatus, comprising:

a pump head;

an actuator that penetrates into the pump head;

a sealed region disposed about the actuator to form a fluid-free zone; and a fluid sensing unit coupled with the sealed region, the fluid sensing unit comprising:

a receptacle that is configured to retain fluid that transits from inside the sealed region, the receptacle having a port that resides proximate its top, and a first valve disposed in the receptacle in proximity to the port, the valve operative to regulate flow of fluid through the port in response to a fluid level in the receptacle.

2. The apparatus of claim 1, further comprising:

a first conduit extending from the sealed region to the receptacle, the first conduit configured to receive fluid from the sealed region; and a second conduit extending from the receptacle and disposed in spaced relation to the first conduit, the second conduit configured to receive fluid from inside the receptacle.

3. The apparatus of claim 1, further comprising:

a switch that is configured to control movement of the actuator in response to fluid in the receptacle.

4. The apparatus of claim 1, further comprising:

a motor coupled with the actuator; and a switch coupled with the motor and having a state that stops the motor in response to fluid in the receptacle.

5. The apparatus of claim 1, further comprising:

a sensor coupled with the receptacle and configured to generate a signal in response to fluid in the receptacle.

6. The apparatus of claim 1, further comprising:

a housing enclosing the actuator, the sealed region, and the fluid sensing unit.

7. The apparatus of claim 1, further comprising:

a housing having a peripheral wall forming an interior space; and an aperture disposed in the peripheral wall that allows access to the interior space, wherein the receptacle is visible only through the aperture.

8. The apparatus of claim 1, further comprising:

a second valve disposed outside the receptacle and in proximity to the port, the valve operative to stop flow of fluid through the port.

9. The apparatus of claim 1, further comprising:

radial seals spaced apart from another along the shaft to form the sealed region.

10. An additive pump, comprising:

a pump head having an inlet and a discharge;

a housing adapted to couple with the pump head, the housing having a peripheral wall that encloses, a shaft with an end in proximity to the pump head;

a sealed region through which the shaft can transit, the sealed region configured to prevent ingress of fluid during movement of the shaft;

a receptacle in flow connection with the sealed region, the receptacle having a port that resides proximate its top, and a first valve disposed in the receptacle in proximity to the port, the valve operative to regulate flow of fluid through the port in response to a fluid level in the receptacle.

11. The additive pump of claim 10, further comprising:

radial seals that receive the shaft and are spaced apart from one another to create the sealed region.

12. The additive pump of claim 10, wherein the first valve disposed inside of the receptacle seals the port with fluid in the receptacle at or below the port.

13. The additive pump of claim 10, further comprising:

a sensor coupled to the receptacle and configured to provide a response that corresponds with the fluid level in the receptacle.

14. The additive pump of claim 10, further comprising:

an electric motor coupled with the shaft;

a sensor coupled with the receptacle; and a switch coupled with the sensor and the electric motor, the switching having states to turn the motor on and off in response to a signal from the sensor that corresponds with the fluid level in the receptacle.

15. A method, comprising:

connecting a receptacle to a sealed region of an additive pump that prevents ingress of chemical additive in proximity to a reciprocating shaft;

collecting chemical additive in the receptacle that penetrates the sealed region;

generating a signal that indicates chemical additive is in the receptacle;

turning off the electric motor in response the signal; and actuating a first valve to regulate flow of a chemical additive from a port in the receptacle in response to chemical additive level in the receptacle.

16. The method of claim 15, further comprising:

switching a switch from a first state to a second state in response to the signal, one of the first state or the second state de-energizing the electric motor.

17. The method of claim 15, further comprising:

allowing chemical additive from the receptacle to re-enter the additive pump.

18. The method of claim 15, further comprising:

causing a float to rise and fall in response to chemical additive in the receptacle, wherein the signal corresponds with a position for the float.

19. The additive pump of claim 10, further comprising:

a second valve disposed outside of the receptacle, the second valve operative to stop flow of fluid through the port.

20. The additive pump of claim 15, further comprising:

actuating a second valve to regulate flow of the chemical additive from the port in the receptacle in response to the chemical additive level in the receptacle.

* * * * *